US007299852B1

(12) United States Patent
Chuang

(10) Patent No.: US 7,299,852 B1
(45) Date of Patent: Nov. 27, 2007

(54) VERTICAL BLIND THAT IS EXPANDED AND FOLDED QUICKLY AND CONVENIENTLY

(76) Inventor: Shan-Chi Chuang, 23, Wucyuan 5th Rd., Wugu Township, Taipei County (TW)

( * ) Notice: Subject to any disclaimer, the term of this patent is extended or adjusted under 35 U.S.C. 154(b) by 0 days.

(21) Appl. No.: 11/541,869

(22) Filed: Oct. 2, 2006

(51) Int. Cl.
*E05D 15/06* (2006.01)

(52) U.S. Cl. ..... 160/197; 160/222

(58) Field of Classification Search ..... 160/214, 160/197, 200, 202, 208, 222, 223, 226, 227, 160/228, 37, 32, 126; 16/96 R, 94 D, 87 B, 16/87 R, 93 D
See application file for complete search history.

(56) References Cited

U.S. PATENT DOCUMENTS 3,348,603 A * 10/1967 Ford ..... 160/197
3,642,051 A * 2/1972 Goldner ..... 160/197
3,911,991 A * 10/1975 Malferrari ..... 160/202
4,073,034 A * 2/1978 Martens ..... 16/87 B
5,109,912 A * 5/1992 Gary ..... 160/330
6,003,583 A * 12/1999 Lacoste et al. ..... 160/122
6,892,783 B1 * 5/2005 Comeau et al. ..... 160/126

* cited by examiner

*Primary Examiner*—Blair M. Johnson
(74) *Attorney, Agent, or Firm*—Alan Kamrath; Kamrath & Associates P.A.

(57) ABSTRACT

A vertical blind includes a headrail, a fixing bracket, a plurality of juxtaposed movable brackets, a drive bracket, a plurality of driven blocks, a plurality of drive blocks, a plurality of mounting seats, a plurality of shades, a pull cord unit, and a positioning unit. Thus, the vertical blind contains multiple movable brackets movable between the fixing bracket and the drive bracket, so that the length of the vertical blind is expanded freely to fit the size of the window, thereby enhancing the versatility of the vertical blind. In addition, the mounting seats have different lengths corresponding to the positions of the fixing bracket and the movable brackets, so that the movable brackets are movable smoothly without interfering with each other, thereby facilitating operation of the vertical blind.

18 Claims, 9 Drawing Sheets

VERTICAL BLIND THAT IS EXPANDED AND FOLDED QUICKLY AND CONVENIENTLY

BACKGROUND OF THE INVENTION

1. Field of the Invention

The present invention relates to a vertical blind and, more particularly, to a vertical blind having multiple upright shades that are pushed and pulled piece by piece.

2. Description of the Related Art

A conventional vertical blind in accordance with the prior art shown in FIG. 9 comprises a headrail 5, three carriers 1 movably mounted on the headrail 5 by roller seats 4, and three shades (not shown) each attached to a respective carrier 1. Thus, the carriers 1 are movable on the headrail 5 to expand or fold the shades. When the vertical blind contains more than three carriers 1, the roller seats 4 easily interfere with each other, so that the carriers 1 cannot be moved smoothly. Thus, the vertical blind contains three carriers 1 only and cannot be expanded to increase its length, so that the length of the vertical blind is limited, thereby limiting the versatility of the vertical blind.

BRIEF SUMMARY OF THE INVENTION

The primary objective of the present invention is to provide a vertical blind that is expanded and folded quickly and conveniently.

Another objective of the present invention is to provide a vertical blind, wherein the vertical blind comprises multiple movable brackets movable between the fixing bracket and the drive bracket, so that the length of the vertical blind is expanded freely to correspond to the size of the window, thereby enhancing the versatility of the vertical blind.

A further objective of the present invention is to provide a vertical blind, wherein the mounting seats have different lengths to correspond to different positions of the fixing bracket and the movable brackets, so that the movable brackets are movable between the fixing bracket and the drive bracket smoothly without interfering with each other, thereby facilitating operation of the vertical blind.

A further objective of the present invention is to provide a vertical blind, wherein the drive block is guided by the respective first mounting groove, and the driven block is guided by the respective second mounting groove, so that the movable brackets and the drive bracket are movable smoothly, thereby facilitating the user operating the vertical blind.

A further objective of the present invention is to provide a vertical blind, wherein the attractive metallic plate of each of the movable brackets is attracted magnetically by the magnet of the positioning unit, so that each of the movable brackets is positioned temporarily by the positioning unit to prevent the movable brackets from being drawn and moved freely during expansion of the vertical blind.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
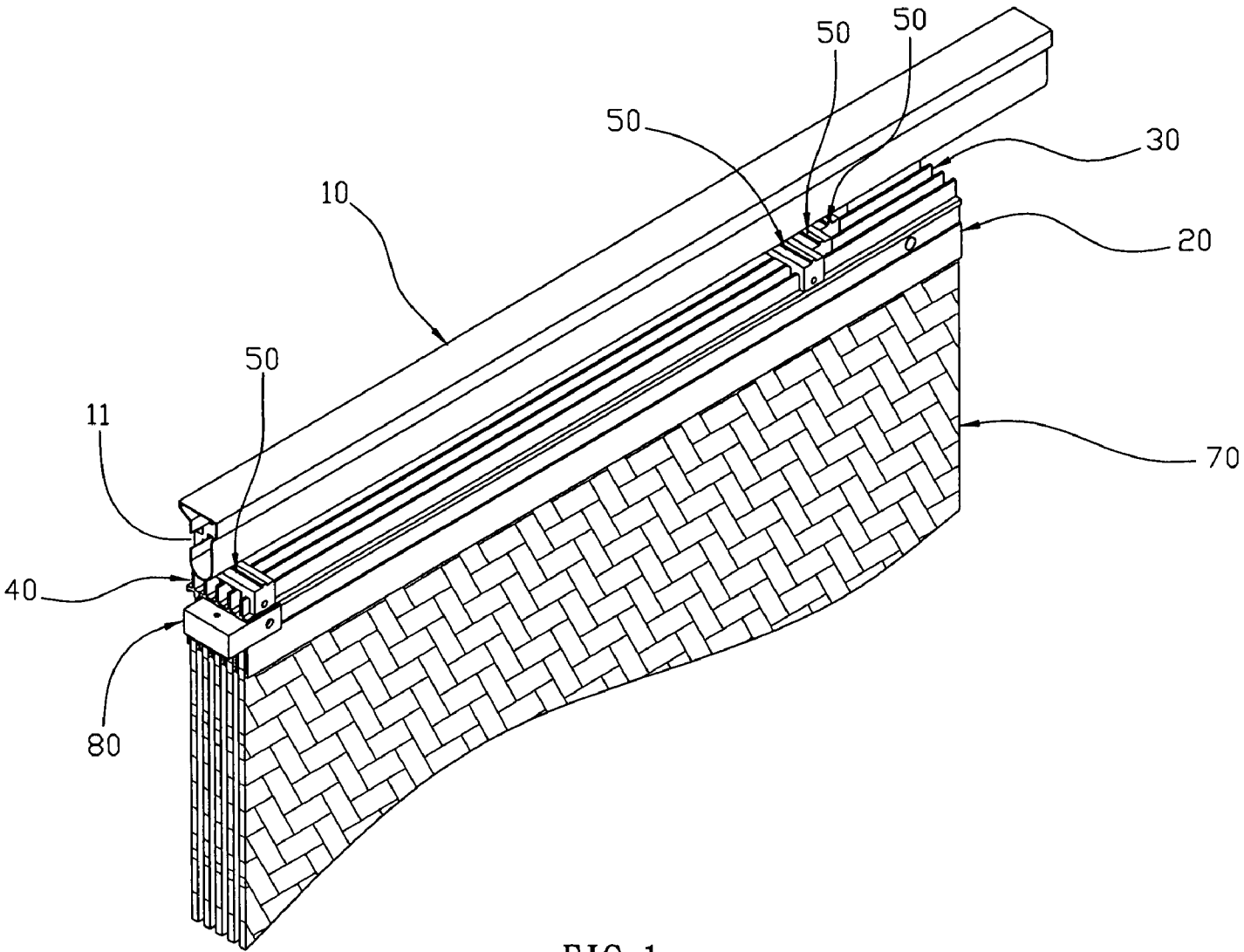
FIG. 1 is a partially cut-away perspective view of a vertical blind in accordance with the preferred embodiment of the present invention.
Figure 2:
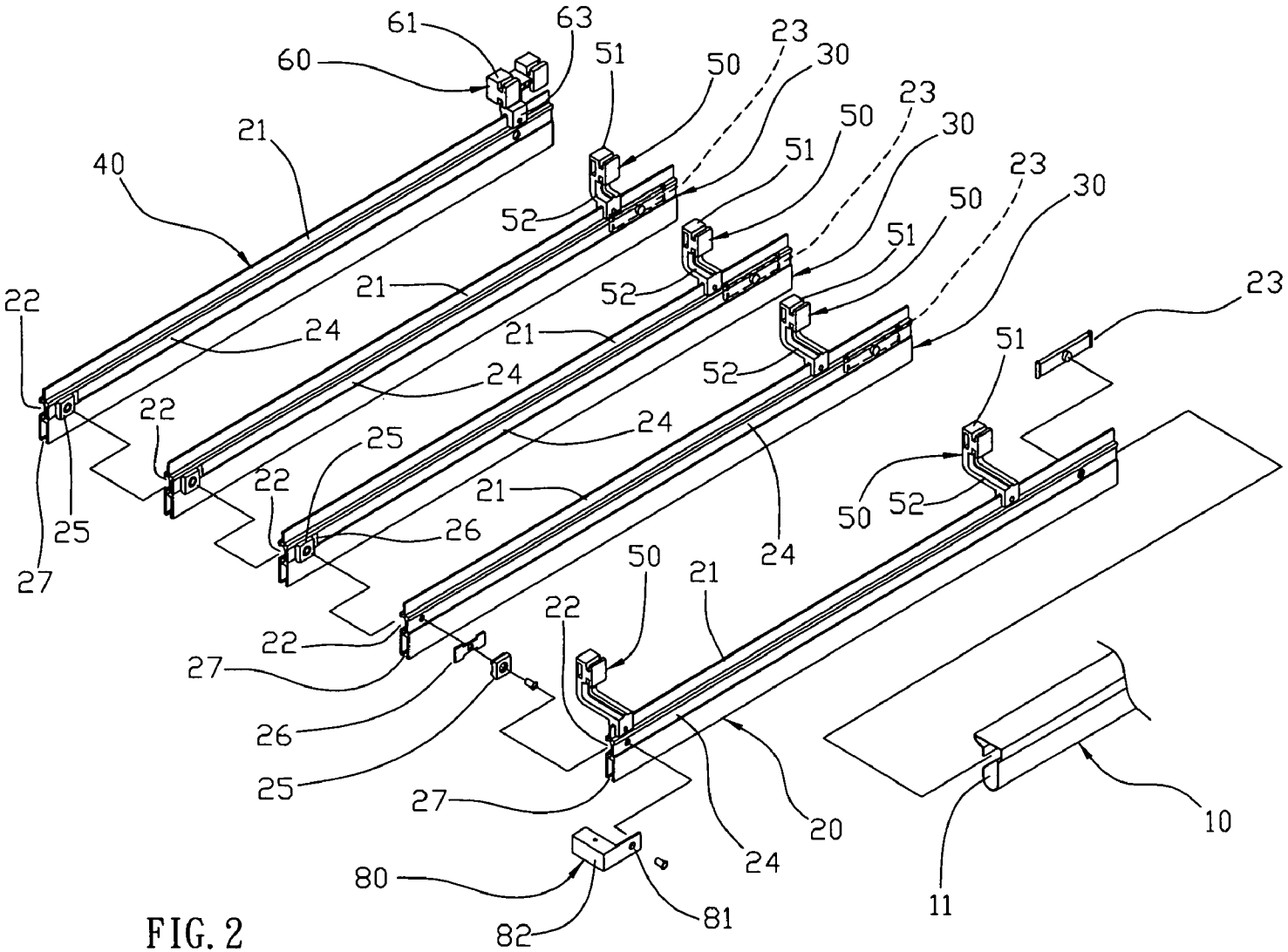
FIG. 2 is a partially exploded perspective view of the vertical blind as shown in FIG. 1.
Figure 3:
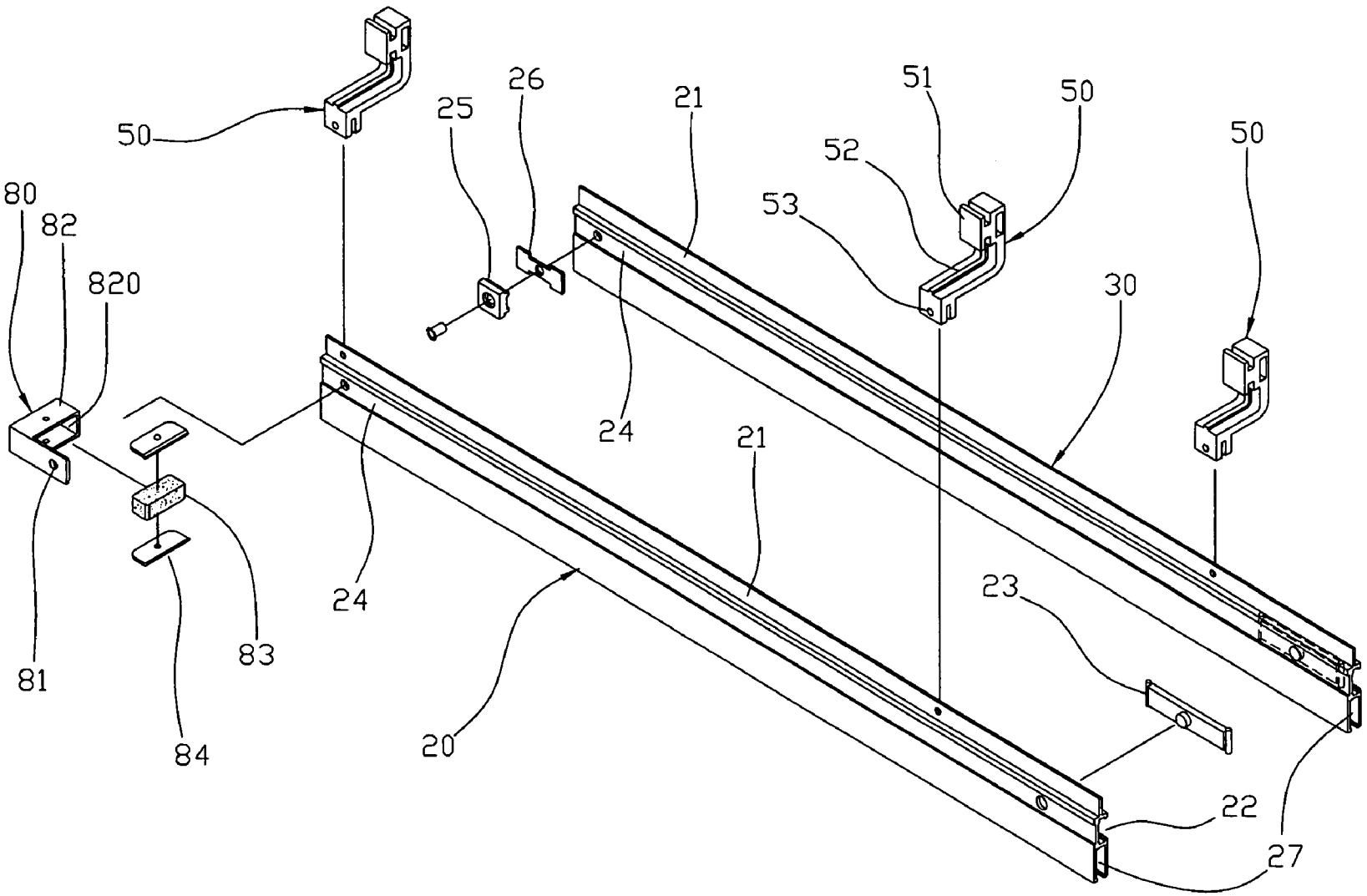
FIG. 3 is a partially exploded perspective view of the vertical blind as shown in FIG. 1.
Figure 4:
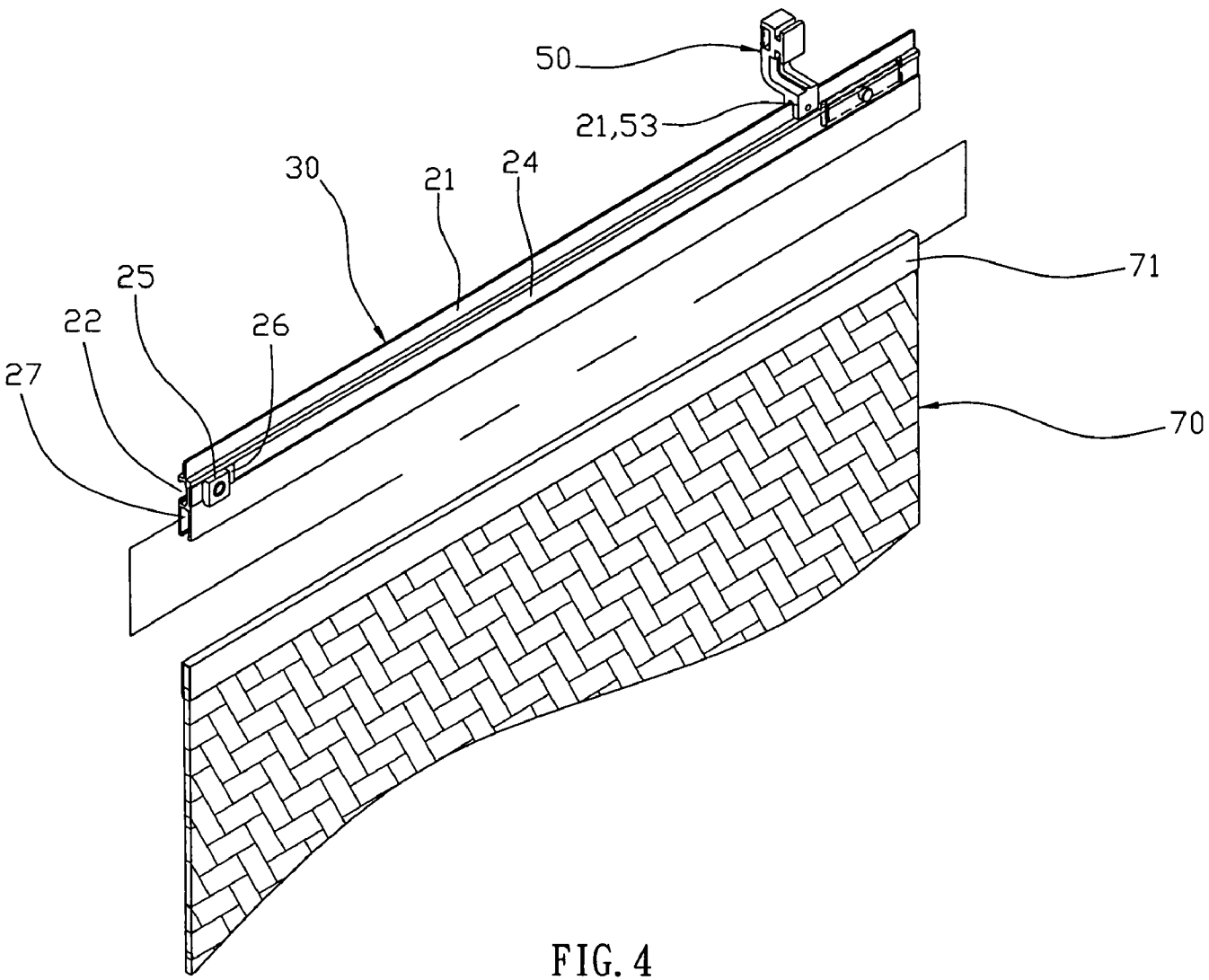
FIG. 4 is a partially exploded perspective view of the vertical blind as shown in FIG. 1.

Referring to the drawings and initially to FIGS. 1-5, a vertical blind in accordance with the preferred embodiment of the present invention comprises a headrail 10, a fixing bracket 20 secured on the headrail 10, a plurality of juxtaposed movable brackets 30 movably mounted on the headrail 10 and movable relative to each other wherein a first one of the movable brackets 30 is movable relative to and limited by the fixing bracket 20, a drive bracket 40 movably mounted on the headrail 10 and movable to rest on a last one of the movable brackets 30 so as to pull the movable brackets 30, a plurality of driven blocks 23 mounted on the fixing bracket 20 and the movable brackets 30, a plurality of drive blocks 25 mounted on the movable brackets 30 and the drive bracket 40 and movable to rest on a respective driven block 23 to drive the respective driven block 23, a plurality of mounting seats 50 mounted on the fixing bracket 20 and the movable brackets 30 to attach the fixing bracket 20 and the movable brackets 30 to the headrail 10, a plurality of shades 70 mounted on the fixing bracket 20, the movable brackets 30 and the drive bracket 40, a pull cord unit 60 mounted on the drive bracket 40 to attach the drive bracket 40 to the headrail 10 and to move the drive bracket 40, and a positioning unit 80 mounted on the fixing bracket 20.

The headrail 10 has an axially extending open slideway 11 to receive the fixing bracket 20, the movable brackets 30 and the drive bracket 40.

Each of the fixing bracket 20, the movable brackets 30 and the drive bracket 40 has the same construction that is worked by an aluminum extruding process. Each of the fixing bracket 20, the movable brackets 30 and the drive bracket 40 has an upper portion formed with a fixing portion 21 and a lower portion formed with a mounting channel 27 for mounting the shades 70.

Each of the fixing bracket 20, the movable brackets 30 and the drive bracket 40 has a first side formed with a first mounting groove 22 and a second side formed with a second mounting groove 24, wherein each of the driven blocks 23 is secured in the respective first mounting groove 22 of each of the fixing bracket 20 and the movable brackets 30, and each of the drive blocks 25 is secured in the respective second mounting groove 24 of each of the movable brackets 30 and the drive bracket 40. Each of the fixing bracket 20, the movable brackets 30 and the drive bracket 40 has a first end and a second end, wherein each of the driven blocks 23 is located at the first end of each of the fixing bracket 20 and the movable brackets 30, and each of the drive blocks 25 is located at the second end of each of the movable brackets 30 and the drive bracket 40. The second mounting groove 24 of each of the movable brackets 30 is provided with a magnetically attractive metallic plate 26 juxtaposed to the respective drive block 25 and attached to the positioning unit 80.

The fixing bracket 20 is provided with two mounting seats 50 located at the first and second ends of the fixing bracket 20 respectively and secured to the headrail 10 so that the fixing bracket 20 is secured to the headrail 10 by the respective mounting seats 50, and each of the movable brackets 30 is provided with a mounting seat 50 located at the first end of each of the movable brackets 30 and movable on the headrail 10 so that each of the movable brackets 30 is movable on the headrail 10 by the respective mounting seat 50. Each of the mounting seats 50 is substantially L-shaped and has a transverse cantilever 52 having a first end formed with an upward extending mounting block 51 attached to the headrail 10 and a second end formed with a downward extending fixing block 53 secured to the fixing portion 21 of each of the fixing bracket 20 and the movable brackets 30. The cantilevers 52 of the mounting seats 50 have different lengths.

The pull cord unit 60 is located at the first end of the drive bracket 40 and movable on the headrail 10 by a pull action of a pull cord (not shown) so that the drive bracket 40 is movable on the headrail 10 by the pull cord unit 60. The pull cord unit 60 has a first end formed with an upward extending mounting block 61 attached to the headrail 10 and a second end formed with a downward extending fixing block 63 secured to the fixing portion 21 of the drive bracket 40.

Each of the shades 70 has a width the same as that of each of the fixing bracket 20, the movable brackets 30 and the drive bracket 40 and has an upper end formed with an enlarged locking strip 71 inserted into the mounting channel 27 of each of the fixing bracket 20, the movable brackets 30 and the drive bracket 40.

The positioning unit 80 is located at the second end of the fixing bracket 20 and includes a housing 82 secured to the fixing bracket 20, two metallic plates 84 mounted in the housing 82, and a magnet 83 mounted in the housing 82 and located between the metallic plates 84 to attract the magnetically attractive metallic plate 26 of each of the movable brackets 30. The housing 82 of the positioning unit 80 has an inside formed with a receiving recess 820 to receive the metallic plates 84 and the magnet 83 and has a side formed with a protruding locking plate 81 secured to the fixing bracket 20.

In assembly, the driven block 23 of the fixing bracket 20 is movable in the respective second mounting groove 24 of the first one of the movable brackets 30, and the drive block 25 of the first one of the movable brackets 30 is movable in the respective first mounting groove 22 of the fixing bracket 20. In addition, the driven block 23 of each of the movable brackets 30 is movable in the respective second mounting groove 24 of an adjacent movable bracket 30, and the drive block 25 of each of the movable brackets 30 is movable in the respective first mounting groove 22 of an adjacent movable bracket 30. In addition, the drive block 25 of the drive bracket 40 is movable in the respective first mounting groove 22 of the last one of the movable brackets 30, and the driven block 23 of the last one of the movable brackets 30 is movable in the respective second mounting groove 24 of the drive bracket 40.

Figure 5:
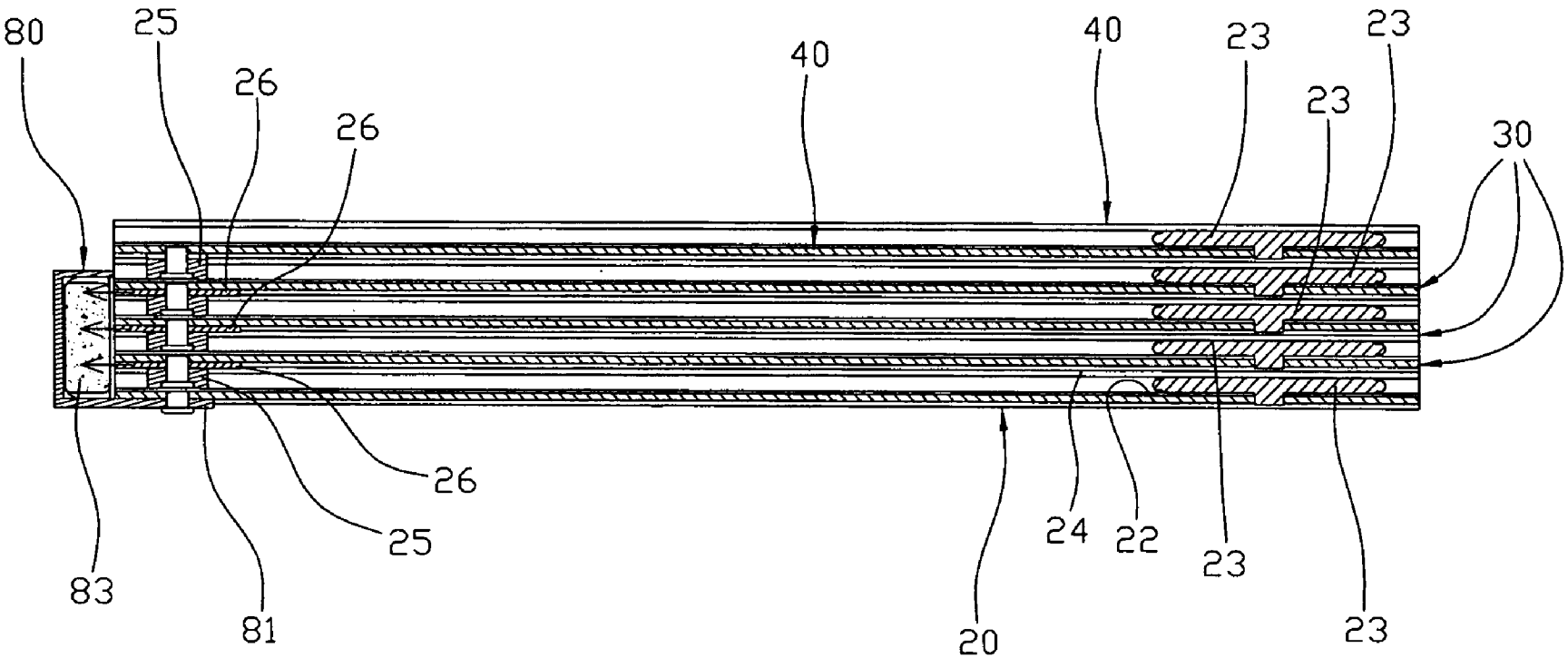
FIG. 5 is a top plan cross-sectional view of the vertical blind as shown in FIG. 1.

In operation, referring to FIGS. 1-7, when the vertical blind is folded, the mounting seat 50 of the first one of the movable brackets 30 is rested on the mounting seat 50 of the first end of the fixing bracket 20, the mounting seat 50 of each of the movable brackets 30 is rested on the mounting seat 50 of an adjacent movable bracket 30, and the pull cord unit 60 of the drive bracket 40 is rested on the mounting seat 50 of the last one of the movable brackets 30 as shown in FIG. 1, so that the fixing bracket 20, the movable brackets 30 and the drive bracket 40 are juxtaposed to each other as shown in FIG. 5 to fold the vertical blind so as to expose the window. At this time, the cantilevers 52 of the mounting seats 50 have different lengths to correspond to different positions of the fixing bracket 20 and the movable brackets 30, so that the mounting blocks 51 of the mounting seats 50 of the fixing bracket 20 and the movable brackets 30 are located at the same horizontal line.

Figure 6:
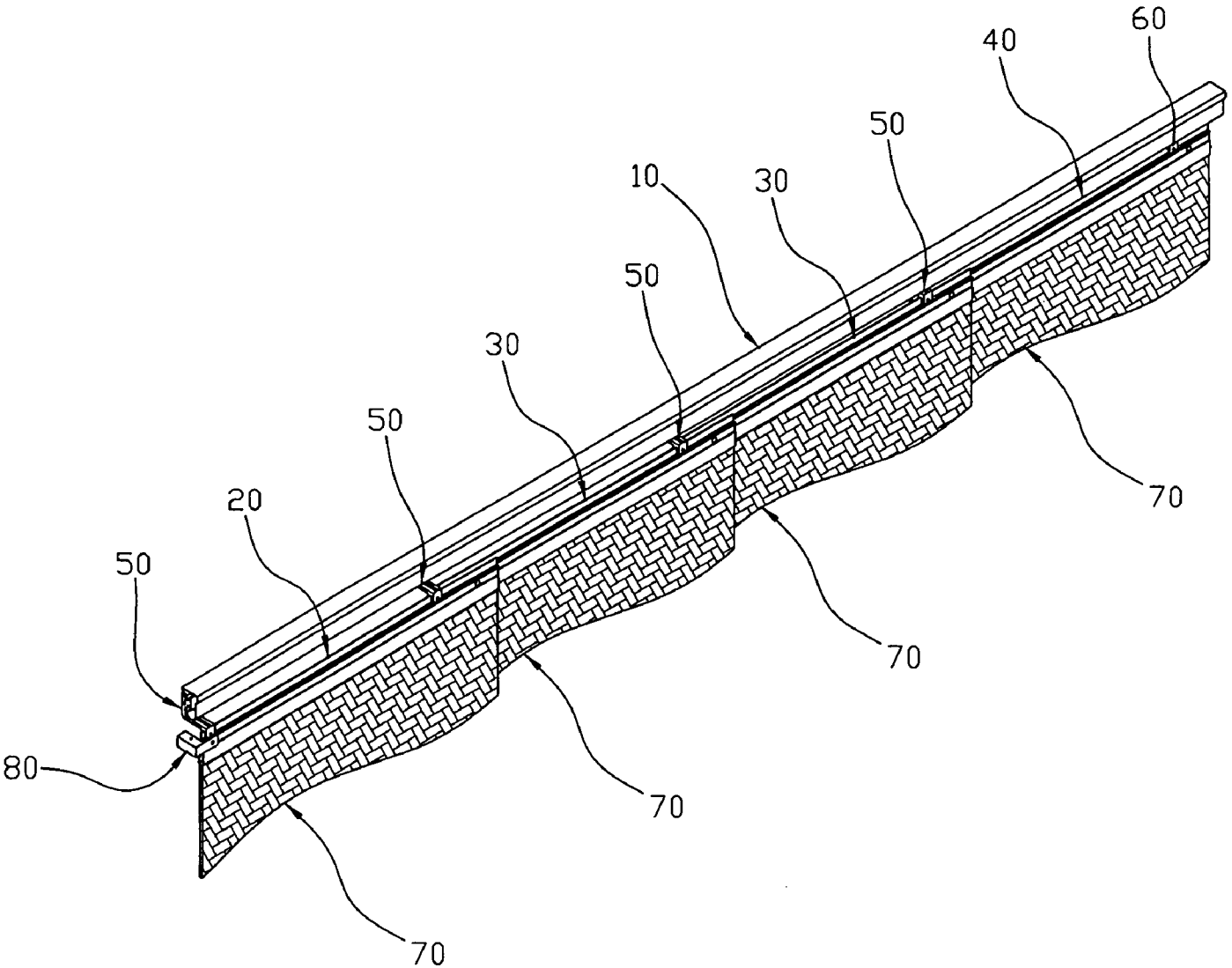
FIG. 6 is a schematic operational view of the vertical blind as shown in FIG. 1.
Figure 7:
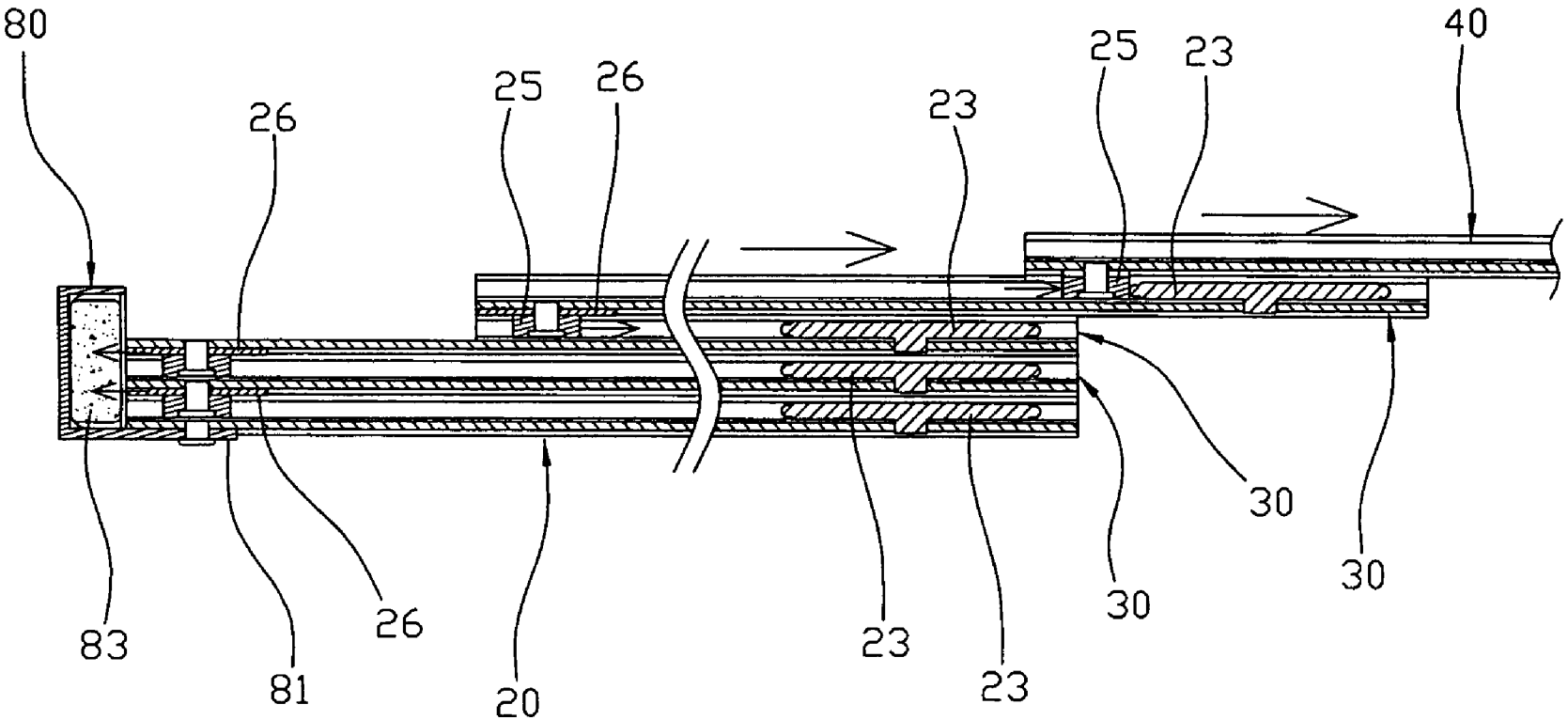
FIG. 7 is a schematic operational view of the vertical blind as shown in FIG. 5.

When the user wishes to expand the vertical blind, the pull cord unit 60 is operated by the pull cord to pull the drive bracket 40 rightward (or inwardly). When the drive block 25 of the drive bracket 40 is movable to rest on the driven block 23 of the last one of the movable brackets 30 as shown in FIG. 7, the last one of the movable brackets 30 is pulled by the drive bracket 40 to move rightward (or inwardly). Then, the drive block 25 of each of the movable brackets 30 is movable to rest on the driven block 23 of an adjacent movable bracket 30, so that the movable brackets 30 are in turn driven by the drive bracket 40 to move rightward (or inwardly). Finally, when the drive block 25 of the first one of the movable brackets 30 is movable to rest on the driven block 23 of the fixing bracket 20, the first one of the movable brackets 30 is stopped by the fixing bracket 20 so as to stop movement of the movable brackets 30 and the drive bracket 40, so that the vertical blind is fully expanded as shown in FIG. 6 so as to cover the window.

As shown in FIG. 5, the magnetically attractive metallic plate 26 of each of the movable brackets 30 is attracted magnetically by the magnet 83 of the positioning unit 80, so that each of the movable brackets 30 is positioned temporarily by the positioning unit 80 to prevent the movable brackets 30 from being drawn and moved freely during expansion of the vertical blind.

When the user wishes to fold the vertical blind, the pull cord unit 60 is operated by the pull cord to push the drive bracket 40 leftward (or outwardly). When the pull cord unit 60 of the drive bracket 40 is movable to rest on the mounting seat 50 of the last one of the movable brackets 30, the last one of the movable brackets 30 is pushed by the drive bracket 40 to move leftward (or outwardly). Then, the mounting seat 50 of each of the movable brackets 30 is movable to rest on the mounting seat 50 of an adjacent movable bracket 30, so that the movable brackets 30 are pushed by the drive bracket 40 to move leftward (or outwardly). Finally, when the mounting seat 50 of the first one of the movable brackets 30 is movable to rest on the mounting seat 50 of the fixing bracket 20, the first one of the movable brackets 30 is stopped by the fixing bracket 20 so as to stop movement of the movable brackets 30 and the drive bracket 40, so that the vertical blind is fully folded as shown in FIG. 1 so as to expose the window.

Figure 8:
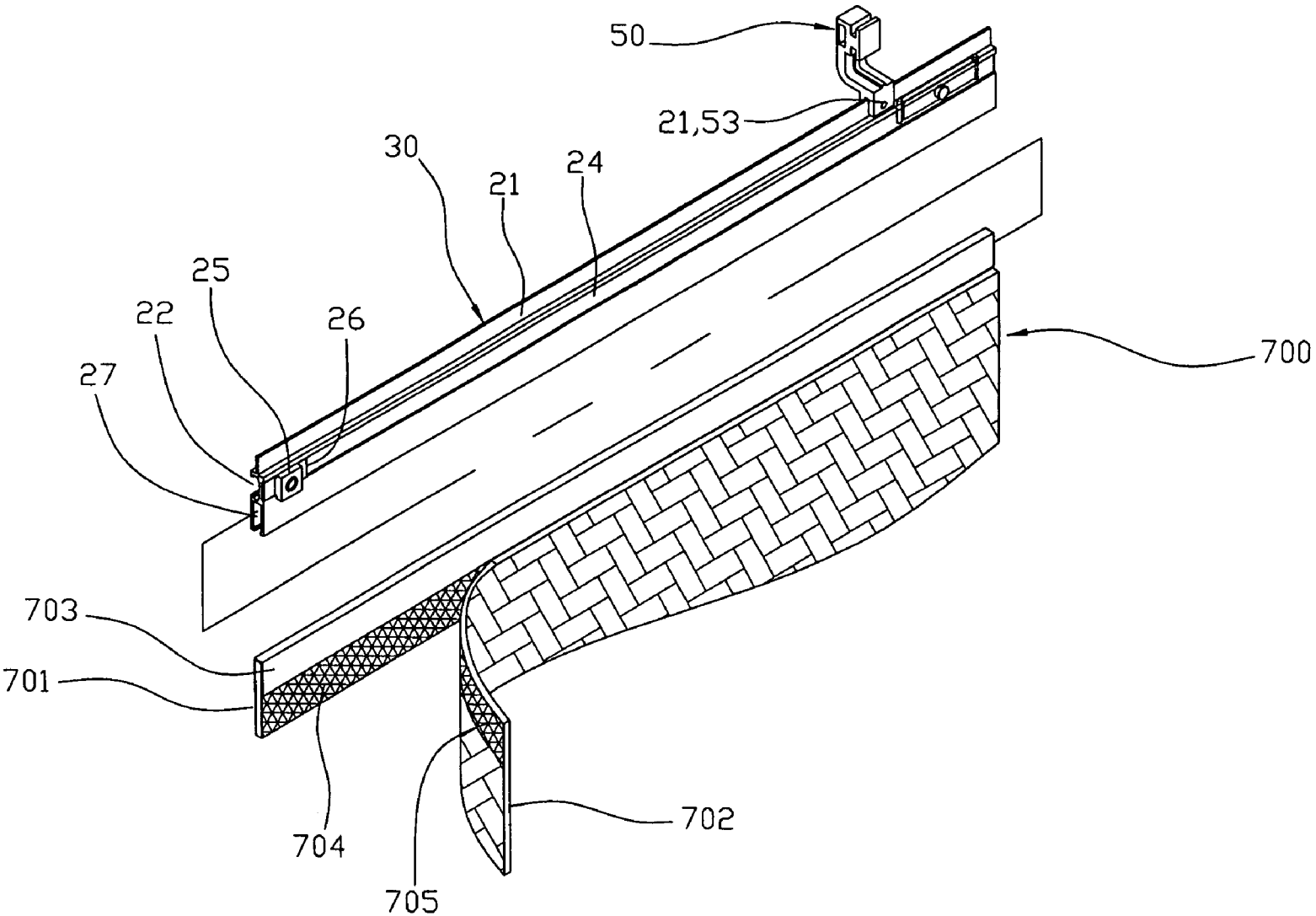
FIG. 8 is a partially exploded perspective view of a vertical blind in accordance with another preferred embodiment of the present invention.
Figure 9:
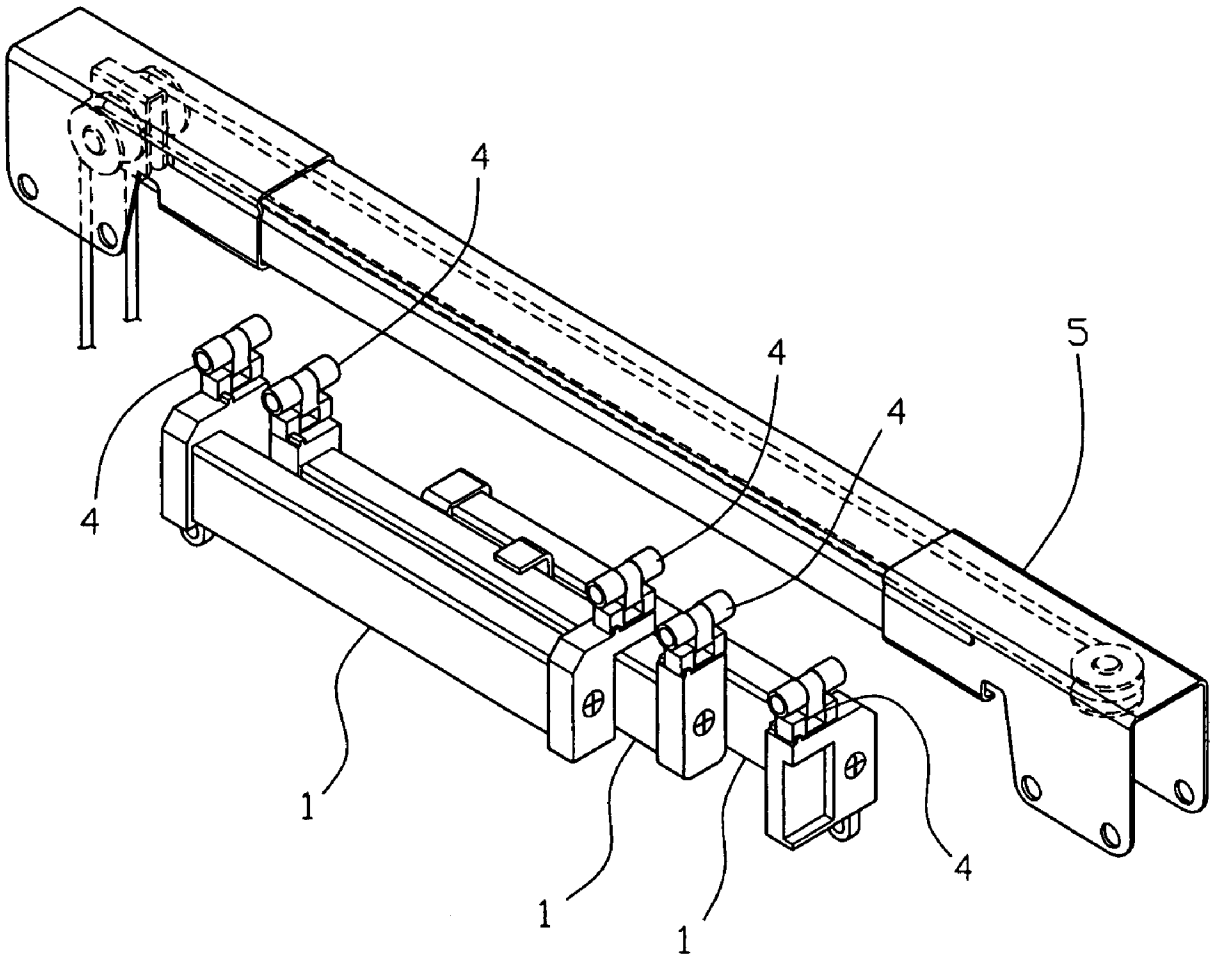
FIG. 9 PRIOR ART
FIG. 9 is a partially exploded perspective view of a conventional vertical blind in accordance with the prior art.

As shown in FIG. 8, each of the shades 700 includes a connecting plate 701 attached to each of the fixing bracket 20, the movable brackets 30 and the drive bracket 40, and a shade cloth 702 removably mounted on the connecting plate 701. The connecting plate 701 of each of the shades 700 has an upper end formed with an enlarged locking strip 703 inserted into the mounting channel 27 of each of the fixing bracket 20, the movable brackets 30 and the drive bracket 40 and a lower end formed with a bonding portion 704. The shade cloth 702 of each of the shades 700 has an upper end formed with a bonding section 705 detachably bonded onto the bonding portion 704 of the connecting plate 701.

Accordingly, the vertical blind comprises multiple movable brackets 30 movable between the fixing bracket 20 and the drive bracket 40, so that the length of the vertical blind is expanded freely to correspond to the size of the window, thereby enhancing the versatility of the vertical blind. In addition, the mounting seats 50 have different lengths to correspond to different positions of the fixing bracket 20 and the movable brackets 30, so that the movable brackets 30 are movable between the fixing bracket 20 and the drive bracket 40 smoothly without interfering with each other, thereby facilitating operation of the vertical blind. Further, the drive block 25 is guided by the respective first mounting groove 22, and the driven block 23 is guided by the respective second mounting groove 24, so that the movable brackets 30 and the drive bracket 40 are movable smoothly, thereby facilitating the user operating the vertical blind. Further, the magnetically attractive metallic plate 26 of each of the movable brackets 30 is attracted magnetically by the magnet 83 of the positioning unit 80, so that each of the movable brackets 30 is positioned temporarily by the positioning unit 80 to prevent the movable brackets 30 from being drawn and moved freely during expansion of the vertical blind.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A vertical blind, comprising:

a headrail;

a fixing bracket secured on the headrail;

a plurality of juxtaposed movable brackets movably mounted on the headrail and movable relative to each other wherein a first one of the movable brackets is movable relative to and limited by the fixing bracket;

a drive bracket movably mounted on the headrail and movable to rest on a last one of the movable brackets so as to pull the movable brackets;

a plurality of driven blocks mounted on the fixing bracket and the movable brackets;

a plurality of drive blocks mounted on the movable brackets and the drive bracket and movable to rest on a respective driven block to drive the respective driven block;

a plurality of mounting seats mounted on the fixing bracket and the movable brackets to attach the fixing bracket and the movable brackets to the headrail;

a portion of the mounting seats being collinear about a horizontal axis;

a plurality of shades mounted on the fixing bracket, the movable brackets and the drive bracket;

a pull cord unit mounted on the drive bracket to attach the drive bracket to the headrail and to move the drive bracket;

a positioning unit mounted on the fixing bracket;

wherein each of the fixing bracket, the movable brackets and the drive bracket has a first side formed with a first mounting groove and a second side formed with a second mounting groove, each of the driven blocks is secured in the respective first mounting groove of each of the fixing bracket and the movable brackets, and each of the drive blocks is secured in the respective second mounting groove of each of the movable brackets and the drive bracket.

2. The vertical blind in accordance with claim 1, wherein the second mounting groove of each of the movable brackets is provided with a magnetically attractive metallic plate juxtaposed to the respective drive block and attached to the positioning unit, the magnetically attractive metallic plate of each of the movable brackets is attracted magnetically by the positioning unit, so that each of the movable brackets is positioned temporarily by the positioning unit.

3. The vertical blind in accordance with claim 2, wherein the positioning unit includes a housing secured to the fixing bracket, two metallic plates mounted in the housing, and a magnet mounted in the housing and located between the metallic plates to attract the magnetically attractive metallic plate of each of the movable brackets.

4. The vertical blind in accordance with claim 3, wherein the housing of the positioning unit has an inside formed with a receiving recess to receive the metallic plates and the magnet and has a side formed with a protruding locking plate secured to the fixing bracket.

5. The vertical blind in accordance with claim 1, wherein each of the fixing bracket, the movable brackets and the drive bracket has a lower portion formed with a mounting channel for mounting the shades.

6. The vertical blind in accordance with claim 5, wherein each of the shades has an upper end formed with an enlarged locking strip inserted into the mounting channel of each of the fixing bracket, the movable brackets and the drive bracket.

7. The vertical blind in accordance with claim 5, wherein each of the shades includes a connecting plate attached to each of the fixing bracket, the movable brackets and the drive bracket, and a shade cloth removably mounted on the connecting plate.

8. The vertical blind in accordance with claim 7, wherein the connecting plate of each of the shades has an upper end formed with an enlarged locking strip inserted into the mounting channel of each of the fixing bracket, the movable brackets and the drive bracket and a lower end formed with a bonding portion, and the shade cloth of each of the shades has an upper end formed with a bonding section detachably bonded onto the bonding portion of the connecting plate.

9. The vertical blind in accordance with claim 1, wherein the driven block of the fixing bracket is movable in the respective second mounting groove of the first one of the movable brackets, the drive block of the first one of the movable brackets is movable in the respective first mounting groove of the fixing bracket, the driven block of each of the movable brackets is movable in the respective second mounting groove of an adjacent movable bracket, the drive block of each of the movable brackets is movable in the respective first mounting groove of an adjacent movable bracket, the drive block of the drive bracket is movable in the respective first mounting groove of the last one of the movable brackets, and the driven block of the last one of the movable brackets is movable in the respective second mounting groove of the drive bracket.

10. The vertical blind in accordance with claim 1, wherein when the vertical blind is folded, the mounting seat of the first one of the movable brackets is rested on the respective mounting seat of the fixing bracket, the mounting seat of each of the movable brackets is rested on the mounting seat of an adjacent movable bracket, and the pull cord unit of the drive bracket is rested on the mounting seat of the last one of the movable brackets, so that the fixing bracket, the movable brackets and the drive bracket are juxtaposed to each other.

11. The vertical blind in accordance with claim 1, wherein each of the fixing bracket, the movable brackets and the drive bracket has the same construction, and each of the shades has a width the same as that of each of the fixing bracket, the movable brackets and the drive bracket.

12. The vertical blind in accordance with claim 1, wherein each of the mounting seats is substantially L-shaped.

13. The vertical blind in accordance with claim 1, wherein the headrail has an axially extending open slideway to receive the fixing bracket, the movable brackets and the drive bracket.

14. A vertical blind, comprising:

a headrail;

a fixing bracket secured on the headrail;

a plurality of juxtaposed movable brackets movably mounted on the headrail and movable relative to each other wherein a first one of the movable brackets is movable relative to and limited by the fixing bracket;

a drive bracket movably mounted on the headrail and movable to rest on a last one of the movable brackets so as to pull the movable brackets;

a plurality of driven blocks mounted on the fixing bracket and the movable brackets;

a plurality of drive blocks mounted on the movable brackets and the drive bracket and movable to rest on a respective driven block to drive the respective driven block;

a plurality of mounting seats mounted on the fixing bracket and the movable brackets to attach the fixing bracket and the movable brackets to the headrail;

a plurality of shades mounted on the fixing bracket, the movable brackets and the drive bracket;

a pull cord unit mounted on the drive bracket to attach the drive bracket to the headrail and to move the drive bracket;

a positioning unit mounted on the fixing bracket;

wherein each of the fixing bracket, the movable brackets and the drive bracket has a first end and a second end, each of the driven blocks is located at the first end of each of the fixing bracket and the movable brackets, and each of the drive blocks is located at the second end of each of the movable brackets and the drive bracket;

the drive bracket has an upper portion formed with a fixing portion, the pull cord unit has a first end formed with an upward extending mounting block attached to the headrail and a second end formed with a downward extending fixing block secured to the fixing portion of the drive bracket;

a portion of the mounting block and the mounting seats being collinear about a horizontal axis.

15. The vertical blind in accordance with claim 14, wherein the fixing bracket is provided with two mounting seats located at the first and second ends of the fixing bracket respectively and secured to the headrail so that the fixing bracket is secured to the headrail by the respective mounting seats, each of the movable brackets is provided with a mounting seat located at the first end of each of the movable brackets and movable on the headrail so that each of the movable brackets is movable on the headrail by the respective mounting seat, and the pull cord unit is located at the first end of the drive bracket and movable on the headrail so that the drive bracket is movable on the headrail by the pull cord unit.

16. The vertical blind in accordance with claim 14, wherein the positioning unit is located at the second end of the fixing bracket.

17. A vertical blind, comprising:

a headrail;

a fixing bracket secured on the headrail:

a plurality of juxtaposed movable brackets movably mounted on the headrail and movable relative to each other wherein a first one of the movable brackets is movable relative to and limited by the fixing bracket;

a drive bracket movably mounted on the headrail and movable to rest on a last one of the movable brackets so as to pull the movable brackets;

a plurality of driven blocks mounted on the fixing bracket and the movable brackets;

a plurality of drive blocks mounted on the movable brackets and the drive bracket and movable to rest on a respective driven block to drive the respective driven block;

a plurality of mounting seats mounted on the fixing bracket and the movable brackets to attach the fixing bracket and the movable brackets to the headrail;

a plurality of shades mounted on the fixing bracket, the movable brackets and the drive bracket;

a pull cord unit mounted on the drive bracket to attach the drive bracket to the headrail and to move the drive bracket;

a positioning unit mounted on the fixing bracket;

wherein each of the fixing bracket and the movable brackets has an upper portion formed with a fixing portion, and each of the mounting seats has a transverse cantilever having a first end formed with an upward extending mounting block attached to the headrail and a second end formed with a downward extending fixing block secured to the fixing portion of each of the fixing bracket and the movable brackets the mounting blocks being collinear about a horizontal axis.

18. The vertical blind in accordance with claim 17, wherein the cantilevers of the mounting seats have different lengths to correspond to different positions of the fixing bracket and the movable brackets, so that the mounting block of the mounting seats of the fixing bracket and the movable brackets are located at the same horizontal line.

* * * * *